United States Patent [19]

London

[11] Patent Number: 4,724,548

[45] Date of Patent: Feb. 16, 1988

[54] HUGGING NOVELTY DEVICE

[76] Inventor: Jeff London, P.O. Box AA, Amity Station, Woodbridge, Conn. 06525

[21] Appl. No.: 25,669

[22] Filed: Mar. 13, 1987

[51] Int. Cl.[4] ..... A41F 3/02

[52] U.S. Cl. ..... 2/338; 2/170; 2/339; 63/11

[58] Field of Search ..... 2/338, 311, 321, 322, 2/337, 339, 452, 170; 63/11, 7, 8, 5 R

[56] References Cited

U.S. PATENT DOCUMENTS

| | | | |
|---|---|---|---|
| 243,793 | 7/1881 | Richards | 63/11 |
| 279,518 | 6/1883 | Atwood et al. | 63/11 |
| 796,695 | 8/1905 | Blake | 2/339 X |
| 1,559,165 | 10/1925 | Hammond | 63/11 |
| 3,410,023 | 11/1968 | Anello | 63/11 X |
| 3,605,204 | 9/1971 | Amundsen | 2/452 X |

FOREIGN PATENT DOCUMENTS

| | | | |
|---|---|---|---|
| 2801655 | 7/1979 | Fed. Rep. of Germany | 2/170 |

*Primary Examiner*—Louis K. Rimrodt
*Assistant Examiner*—J. L. Olds
*Attorney, Agent, or Firm*—Arthur T. Fattibene

[57] ABSTRACT

An inexpensive novelty device for simulating a hug having a coiled flexible strip that is normally resistant to uncoiling with animated appendages attached to each end. A pair of tabs formed at the ends of the strip cooperatively associated with a notch facilitates the attachment of the simulated appendages to the respective ends of the strip.

2 Claims, 4 Drawing Figures

HUGGING NOVELTY DEVICE

FIELD OF INVENTION

This invention relates generally to the field of novelty devices, and more specifically to a simple, inexpensive device for simulating or providing the perception of a hug or embrace.

PRIOR ART

A large portion of human endeavors are devoted to entertaining other humans. This is evident from the enormous efforts expended by the entertainment industry simply to provide pleasure to humans. A portion of these efforts are expanded in the creation of novelty devices. Novelty devices are used to bring pleasure to oneself or others. In the past, novelty devices have taken a variety of forms. These forms have only been limited by the inventory's imagination. The only common element in this type of device is to deliver the greatest amount of pleasure for the least amount of effort. As a result, great efforts have been expended to produce simple and inexpensive novelty devices.

There have been many prior devices that create the illusion of a real item or event; e.g., the arrow through the head, plastic food items, antennae hats, false faces and masks, and many other similar and non-similar types of novelty devices.

SUMMARY OF THE INVENTION

It is an object of this invention to provide a novelty device capable of entertaining.

It is a further object of this invention to provide an inexpensive and simple novelty device.

It is an advantage of this invention that it is light weight and when stored, reduces to a compact size.

It is a feature of this invention that the ends of a strip have tabs supporting hands attached to the strip.

The novelty device according to the invention uses a strip pre-stressed to form a coil and having a first hand on one end and a second hand on the other end. When the strip is opened against its pre-stressed or predisposed state the first and second hand can be placed around a person or other object to simulate or give the illusions of a hug or embrace.

Other objects, advantages and features of the invention will become apparent from the following detailed description and drawings.

DETAILED DESCRIPTION OF THE PREFERRED EMBODIMENT

Figure 1:
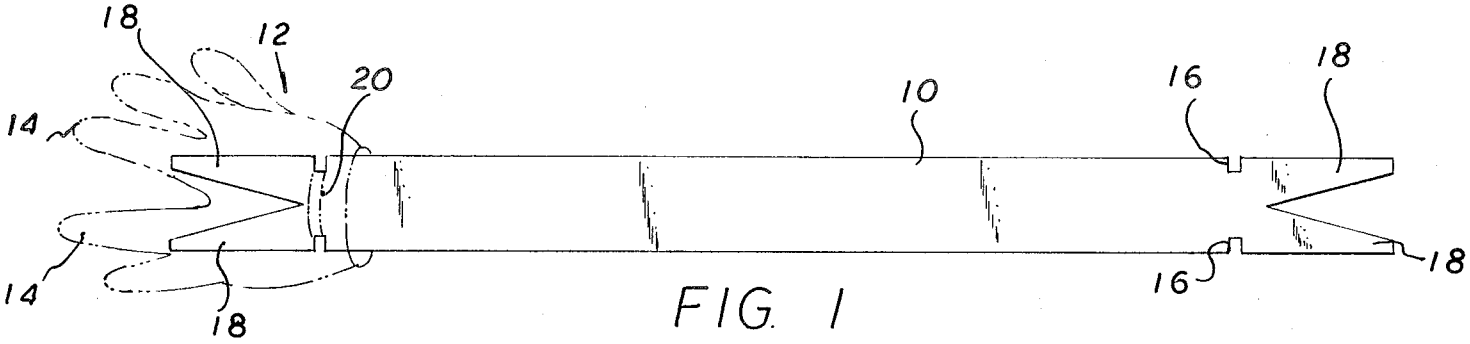
FIG. 1 is a front elevational view of the invention uncoiled.

Novelty devices must be simple and easily constructed to provide economic distribution to the largest number of people, and thereby bring the greatest amount of pleasure. The invention, as is shown in FIG. 1, comprises a bank or strip 10 made of a thin plastic or other resilient material. The strip 10 is shown in an extended position, but does have a predisposed or prestressed state to form a coil when free from external forces. The strip 10 should be of sufficient length so that it can reach around a human torso and thereby emulate an embrace or hug. At each end of the strip 10 are tabs 18. A V-shaped wedge in the strip 10 form the two tabs 18 shown in each end. The number of tabs 18 shown on each end of the strip 10 can vary, but are shown to be two in the preferred embodiment. Along the longitudinal edges of strip 10 are placed notches 16. Notches 16 are positioned at each end near the end of tabs 18 closest to the longitudinal center of the strip 10. The notches 16 can be of many shapes, but are shown in the preferred embodiment as square-shaped. The notches 16 are used to more securely fasten an animated appendage, e.g. a hand 12, to each end of the strip 10. The hand or appendage 12 is placed on each end of the strip 10. The hands 12 can be made of varying shapes and sizes. The hands 12 can even be made to resemble an animal paw or other non-human form for different effects. In the preferred embodiment, the hands 12 resemble a human hand and has five digits 14 each. The hand 12 can be made of many different materials, including padded satin or silk. If desired, the hand or appendage may be stuffed or filled with a suitable filler, e.g., soft rubber, padding or other material to impart a soft feel thereto. The tabs 18 at each end of the strip 10 provide the support for the hand 12 and digits 14. In the preferred embodiment, the tabs 18 are positioned within the second and third digits 14 of each hand 12. The hands 12 each have a means in the form of a collar or the like for attachment to strip 10. Collars 20 are placed over notches 16, and can be made of elastic material or a draw string which, when drawn tight, engages in notches 16, and secures the hands 12 to the strip 10.

Figure 2:
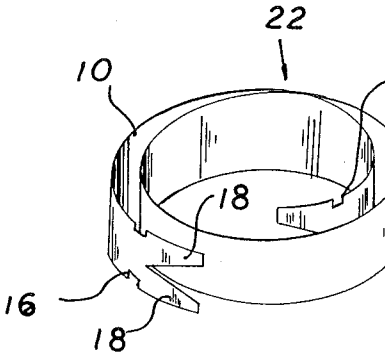
FIG. 2 is a perspective view of a portion of the invention without the hands attached, shown in its normal coiled position.

FIG. 2 illustrates a portion of the invention without the appendage attached. In FIG. 2, the strip 10 is shown in its natural state free from the influence of external forces forming a coil 22. The notches 16 and tabs 18 are visible in this figure.

Figure 3:
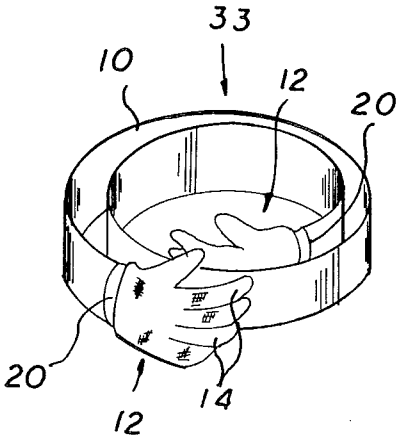
FIG. 3 is a perspective view of the invention in its predisposed or prestressed coiled state.

FIG. 3 shows the invention in a complete assembly 33. The invention can be readily understood by referring to assembly 33. Assembly 33 includes a strip 10, preferably made of flexible plastic, forming a coil. Strip 10 is prestressed so that in its resting state a coil is formed. On each end of strip 10 is placed a padded appendage or hand 12. Each hand 12 is attached to the strip 10 by a collar 20. Each hand 12, as shown, has five digits 14 and is made to resemble a human hand. However, the hand or appendage 12 may take a variety of different shapes and sizes, including other types of animated appendages such as feet, without detracting from the essence of the invention.

Figure 4:
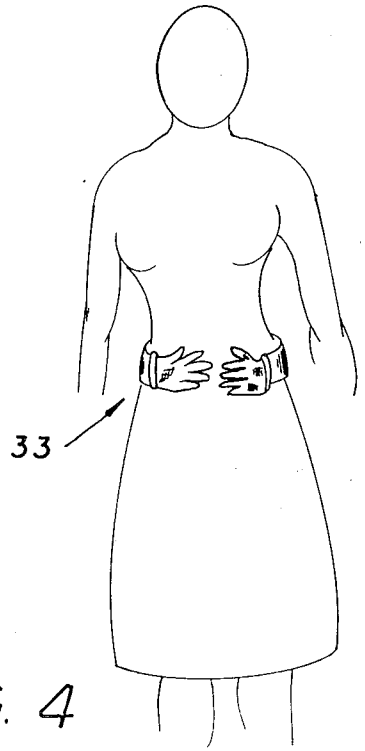
FIG. 4 shows the invention in one position of use.

The operation of the invention can best be understood with reference to FIG. 4. In FIG. 3, the invention is in its natural or unbiased state forming a coil. When operated or used, the coiled strip 10 is biased to its extended position. One hand 12 can then be placed on an individual's side and the other hand 12 can be placed on the individual's other side. The prestressed strip 10, when released, causes the hands 12 on the individual's side to simulate a hug or embrace. Also, when viewed so that the individual is between the viewer and the strip 10, the viewer is given the impression that someone is hugging or embracing the individual.

The inexpensive, easily assembled, and packaged nature of the invention lends itself to being easily incorporated into a marketing or promotional system. The invention can easily be coiled into a small box that can be delivered or mailed to an individual. The invention can represent a surrogate for the hug or embrace of an individual unable to be present in person.

There are many applications of the invention that will bring happiness to a variety of people. Therefore, it should be understood that the foregoing disclosure relates to, but a preferred embodiment of the invention, and that numerous modifications or alterations may be made therein without departing from the spirit and scope of the invention as set forth in the appended claims.

What is claimed is:

1. A hugging novelty device comprising a flat, elongated strip of coilable plastic material which is formed to assume a normal coiled position, and which strip, when stressed, can be readily uncoiled to an expanded position, said flat strip having opposed terminal end portions, said end portions being bifurcated to define at least a pair of tabs having their free end defining the outermost end of said strip, opposed transversely disposed notches formed in the respective opposed edges of said strip adjacent each end of said strip, said notches being spaced inwardly from the free end of said tabs, an animated appendage in the shape of a human hand having a plurality of finger digits detachably connected to each end of said strip, said hand having a collar portion adapted to be fitted over the bifurcated tabs whereby said tabs extend into corresponding finger digits of said animated hand, and attachment means in said collar adapted to be drawn into said notches for positively securing said hand appendage to said strip whereby said strip and connected hand appendages in the extended position simulates an embracing hug due to the inherent resiliency of said strip.

2. A hugging novelty device as defined in claim 1, wherein attachment means includes an elastic.

* * * * *